US008500111B2

(12) United States Patent
Terao

(10) Patent No.: US 8,500,111 B2
(45) Date of Patent: Aug. 6, 2013

(54) SHEET PROCESSING APPARATUS, IMAGE FORMING APPARATUS AND SHEET PROCESSING METHOD

(75) Inventor: Yasunobu Terao, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 11 days.

(21) Appl. No.: 13/354,111

(22) Filed: Jan. 19, 2012

(65) Prior Publication Data

US 2012/0190526 A1 Jul. 26, 2012

Related U.S. Application Data

(60) Provisional application No. 61/435,544, filed on Jan. 24, 2011.

(30) Foreign Application Priority Data

Sep. 22, 2011 (JP) ..... 2011-207096

(51) Int. Cl.
*B31F 1/08* (2006.01)

(52) U.S. Cl.
USPC ..... 270/45; 270/32; 270/58.07

(58) Field of Classification Search
USPC ..... 270/32, 37, 45, 58.07; 493/406, 493/407, 442, 454
See application file for complete search history.

(56) References Cited

U.S. PATENT DOCUMENTS

| | | | | |
|---|---|---|---|---|
| 7,431,274 | B2 * | 10/2008 | Kushida et al. | 270/37 |
| 7,784,777 | B2 | 8/2010 | Dobashi et al. | |
| 7,845,628 | B2 | 12/2010 | Dobashi et al. | |
| 7,850,156 | B2 * | 12/2010 | Iguchi et al. | 270/37 |
| 7,950,643 | B2 | 5/2011 | Kawaguchi | |

OTHER PUBLICATIONS

U.S. Appl. No. 13/192,337, filed Jul. 27, 2011.

* cited by examiner

*Primary Examiner* — Leslie A Nicholson, III
(74) *Attorney, Agent, or Firm* — Patterson & Sheridan, L.L.P.

(57) ABSTRACT

A sheet processing apparatus includes a folding roller unit configured to form a fold in a sheet while the sheet passes through a nip of rollers, and a fold-enhancing roller unit having a first roller, a second roller, and a third roller, the first roller being provided facing a first surface of the sheet, orthogonal to a direction of transport of the sheet, the second and third rollers being provided facing a second surface of the sheet orthogonal to the direction of transport of the sheet and different from the first surface, the second and third rollers forming nips with the first roller, in which the fold-enhancing roller unit is moved along the fold with the sheet nipped in the nip between the first roller and the second roller and in the nip between the first roller and the third roller, to form a fold.

18 Claims, 7 Drawing Sheets

WITH ROLLER UNIT IN HOME POSITION

WITH ROLLER UNIT MOVING
(UNDER FOLD TIGHTENING OPERATION)

SHEET PROCESSING APPARATUS, IMAGE FORMING APPARATUS AND SHEET PROCESSING METHOD

CROSS-REFERENCE TO RELATED APPLICATIONS

This application is based upon and claims the benefit of priority from the prior Japanese Patent Application No. 2011-207096, filed on Sep. 22, 2011, the entire contents of which are incorporated herein by reference. Further this application is also based upon and claims the benefit of priority from the prior U.S. Provisional Application No. 61/435,544, filed on Jan. 24, 2011, the entire contents of which are incorporated herein by reference.

FIELD

Embodiments described herein generally relate to a sheet processing apparatus, an image forming apparatus and a sheet processing method.

BACKGROUND

In a sheet processing apparatus, fold enhancement has heretofore been provided by a folding roller unit. The fold enhancement of a sheet has been accomplished by pinching a fold of the sheet between a pair of fold-enhancing rollers, and moving the pair of fold-enhancing rollers along the fold.

DETAILED DESCRIPTION

The conventional pair of fold-enhancing rollers allows merely the single instantaneous passage of a fold of a sheet between the fold-enhancing rollers. Therefore, application of pressure to a fold portion is insufficient to fold plural sheets at a time, and hence it is possible that the sheets cannot be well folded.

In view of the above circumstances, an aspect of the embodiments provides a sheet processing apparatus capable of performing fold enhancement of sheets.

A sheet processing apparatus according to one embodiment includes a folding roller unit configured to form a fold in a sheet while the sheet passes through a nip of paired rollers; a fold-enhancing roller unit having a first roller, a second roller, and a third roller, the first roller being provided facing a first surface of the sheet folded by the folding roller unit, orthogonal to a direction of transport of the sheet, the second roller and the third roller which are provided facing a second surface of the sheet orthogonal to the direction of transport of the sheet and different from the first surface, the second roller and the third roller forming nips with the first roller.

Furthermore, the sheet processing apparatus includes a drive unit configured to move the fold-enhancing roller unit along the fold with the sheet nipped in the nip between the first roller and the second roller and in the nip between the first roller and the third roller.

One embodiment of the present invention will be described in more detail below with reference to the drawings.

The embodiment will be described by using FIGS. 1 to 11.

Figure 1:
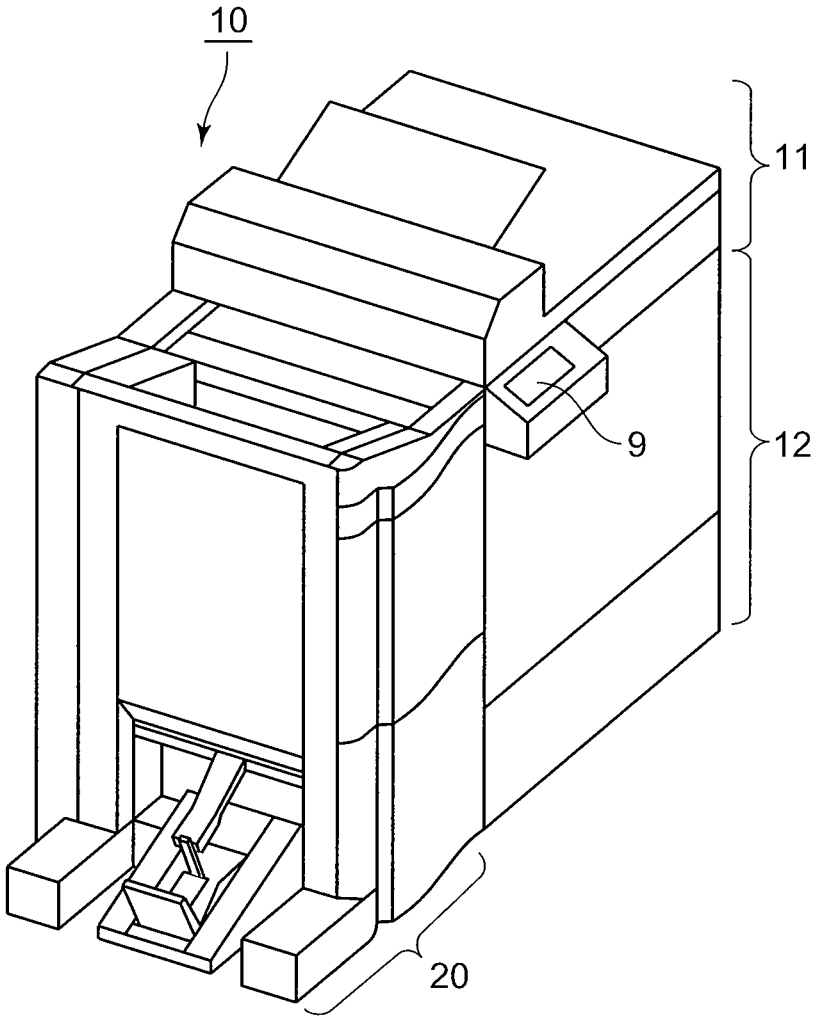
FIG. 1 is a perspective view showing an external appearance of an image forming apparatus.

FIG. 1 is an external perspective view showing an example of basic configuration of an image forming apparatus 10 according to the embodiment. The image forming apparatus 10 is configured by including a reading unit 11 that reads an original document, an image forming unit 12 that prints image data of the read original document on a sheet by electrophotography, a sheet post-processing device 20 that performs post-processing, such as a sorting process, a punching process, a folding process, or a saddle stitch process, on the printed sheet, and so on. Also, the image forming unit 12 is provided with an operation unit 9 for a user to perform various operations.

Figure 2:
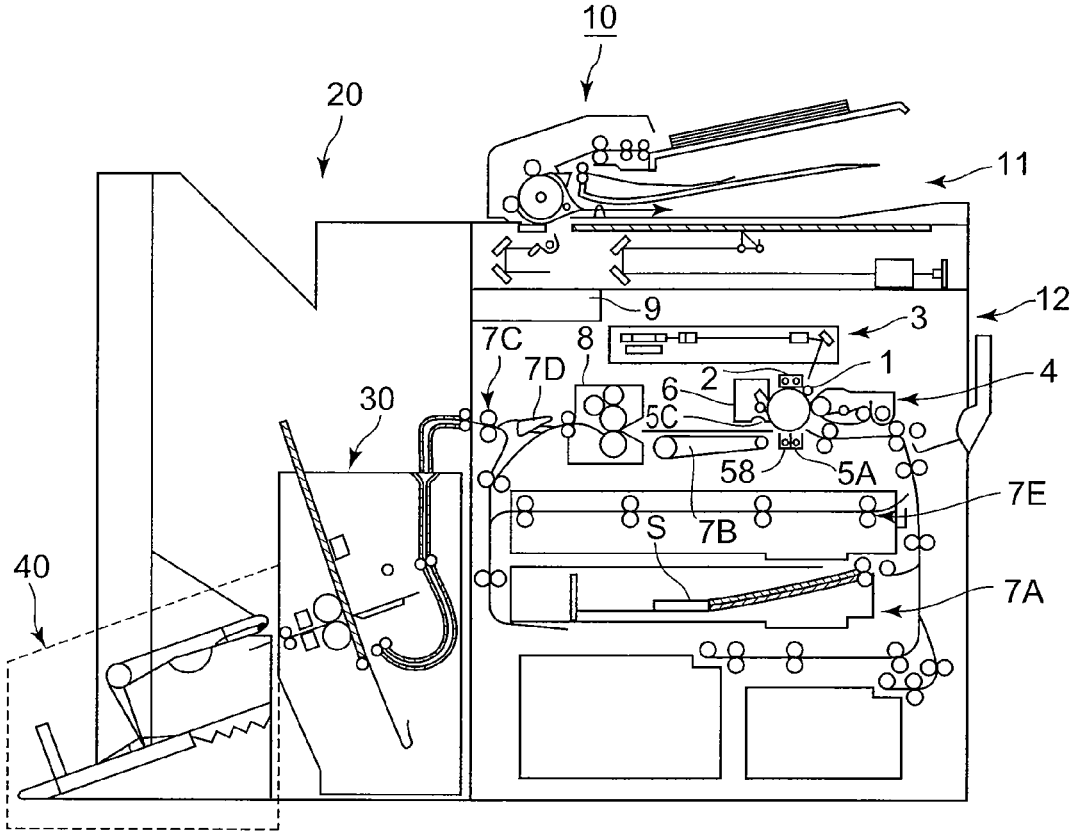
FIG. 2 is a cross-sectional view showing a configuration of the image forming apparatus.

FIG. 2 is a cross-sectional view showing an example of detailed configuration of the image forming apparatus 10.

The image forming unit 12 of the image forming apparatus 10 has a photoconductor drum 1 in its center portion. A charge unit 2, an exposure unit 3, a developing unit 4, a transfer unit 5A, a discharge unit 5B, a separation claw 5C, and a cleaning unit 6 are provided in an arrangement around the photoconductor drum 1. Also, a fixing unit 8 is provided on the downstream side from the discharge unit 5B. These units perform an image forming process generally through the following procedure.

First, the photoconductor drum 1 is uniformly charged over its surface by the charge unit 2. Meanwhile, an original document read by the reading unit 11 is converted into image data, which is then inputted to the exposure unit 3. The exposure unit 3 irradiates the charged photoconductor drum 1 with a laser beam according to level of the image data. Thereby, an electrostatic latent image is formed on the photoconductor drum 1. The electrostatic latent image is developed by toner fed from the developing unit 4, thereby forming a toner image on the photoconductor drum 1.

Meanwhile, a sheet S contained in a sheet container 7A is transported through several transport rollers to a transfer position (i.e. clearance between the photoconductor drum 1 and the transfer unit 5A). At the transfer position, the toner image is transferred from the photoconductor drum 1 to the sheet S by the transfer unit 5A. Electric charge is eliminated by the discharge unit 5B from the surface of the sheet S having the toner image transferred thereto. The sheet S is separated from the photoconductor drum 1 by the separation claw 5C. After that, the sheet S is transported by an intermediate transport unit 7B, and the toner image is fixed to the sheet S through application of heat and pressure by the fixing unit 8. The sheet S on which a fixing process has been completed is ejected through an ejection unit 7C and is outputted to the sheet post-processing device 20.

Meanwhile, the photoconductor drum 1 is prepared for the next image formation by the cleaning unit 6 removing a developer remaining on the surface, downstream from the separation claw 5C.

In the case of double-sided printing, the sheet S having the toner image fixed on the surface is caused to branch off from an usual ejection passage by a transport path switching plate 7D, and is turned over through switch-back by a reverse transport unit 7E. The turned-over sheet S is subjected on its reverse side to the same printing process as single-sided printing, and is outputted through the ejection unit 7C to the sheet post-processing device 20.

The sheet post-processing device 20 has a saddle stitch processor 30 and a sheet bundle loading unit 40, besides a sorter unit that sorts the sheet S.

The saddle stitch processor 30 performs a process (i.e. the saddle stitch process) that involves stapling plural printed sheets ejected from the image forming unit 12, in their center portion, and then, folding the sheets down the middle, thereby binding a booklet.

The booklet obtained by the saddle stitch processor 30 performing the saddle stitch process is outputted to the sheet bundle loading unit 40, where the bound booklet is finally loaded.

Figure 3:
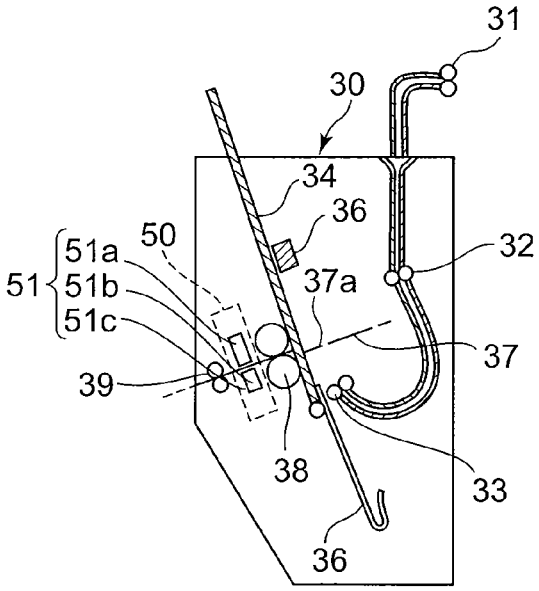
FIG. 3 is a cross-sectional view showing a configuration of a saddle stitch processor.

FIG. 3 is a cross-sectional view showing an example of detailed configuration of the saddle stitch processor 30.

In the saddle stitch processor 30, an inlet roller pair 31 receives the sheet S ejected through the ejection unit 7C of the image forming unit 12 and delivers the sheet to an intermediate roller pair 32. The intermediate roller pair 32 further delivers the sheet to an outlet roller pair 33. The outlet roller pair 33 feeds the sheet S to a standing tray 34 having an inclined loading surface. A leading edge of the sheet S comes to face upward toward a slope of the standing tray 34.

A stacker 35 movable along the standing tray 34 stands by below the standing tray 34, and receives a lower edge of the sheet switching back and sliding down the slope of the standing tray 34 from above.

A stapler (or a saddle stitch unit) 36 is provided halfway along the standing tray 34. To perform the saddle stitch process (or stapling) on a bundle of sheets, the position of the stacker 35 is adjusted so that a position of the bundle of sheets to be stapled (i.e. a center portion of the bundle of sheets in a direction from top to bottom thereof) faces the stapler 36.

When the bundle of sheets is saddle-stitched by the stapler 36, the stacker 35 then moves downward until a position of the bundle of sheets to be folded (i.e. the stapled position, which is the center of the bundle of sheets in the direction from top to bottom thereof) comes to the front of a middle folding blade 37.

When the position to be folded comes to the front of the middle folding blade 37, a leading edge 37*a* of the middle folding blade 37 presses in a surface to be an inside surface after folding of the bundle of sheets.

A folding roller pair 38 is provided ahead of the middle folding blade 37 in its travel direction. The bundle of sheets pressed in by the middle folding blade 37 is caught in a nip portion of the folding roller pair 38, so that a fold is formed in the center portion of the bundle of sheets. The middle folding blade 37 and the folding roller pair 38 form a middle folding unit.

The bundle of sheets having the fold formed by the folding roller pair 38 is transported to a fold-enhancing unit 50 further provided on the downstream side from the folding roller pair 38. The bundle of sheets transported to the fold-enhancing unit 50 is temporarily stopped there from being transported.

The fold-enhancing unit 50 is provided with a fold-enhancing roller pair 51 that forms two paired rolls. The fold-enhancing roller pair 51 is formed of a first roller 51*a*, a second roller 51*b* and a third roller 51*c*. Details of the fold-enhancing roller pair 51 will be described later. The fold-enhancing roller pair 51 tightens the fold by moving while applying pressure to the fold in a direction orthogonal to a direction of transport of the bundle of sheets (that is, in a direction along a fold line).

The bundle of sheets having the fold tightened by the fold-enhancing unit 50 starts being transported again, and is outputted to the sheet bundle loading unit 40 by being pulled by a discharge roller pair 39, and the bundle of sheets subjected to the saddle stitch process (i.e. the booklet) is loaded on the sheet bundle loading unit 40.

The fold-enhancing unit 50 in the embodiment will be described in detail.

Figure 4:
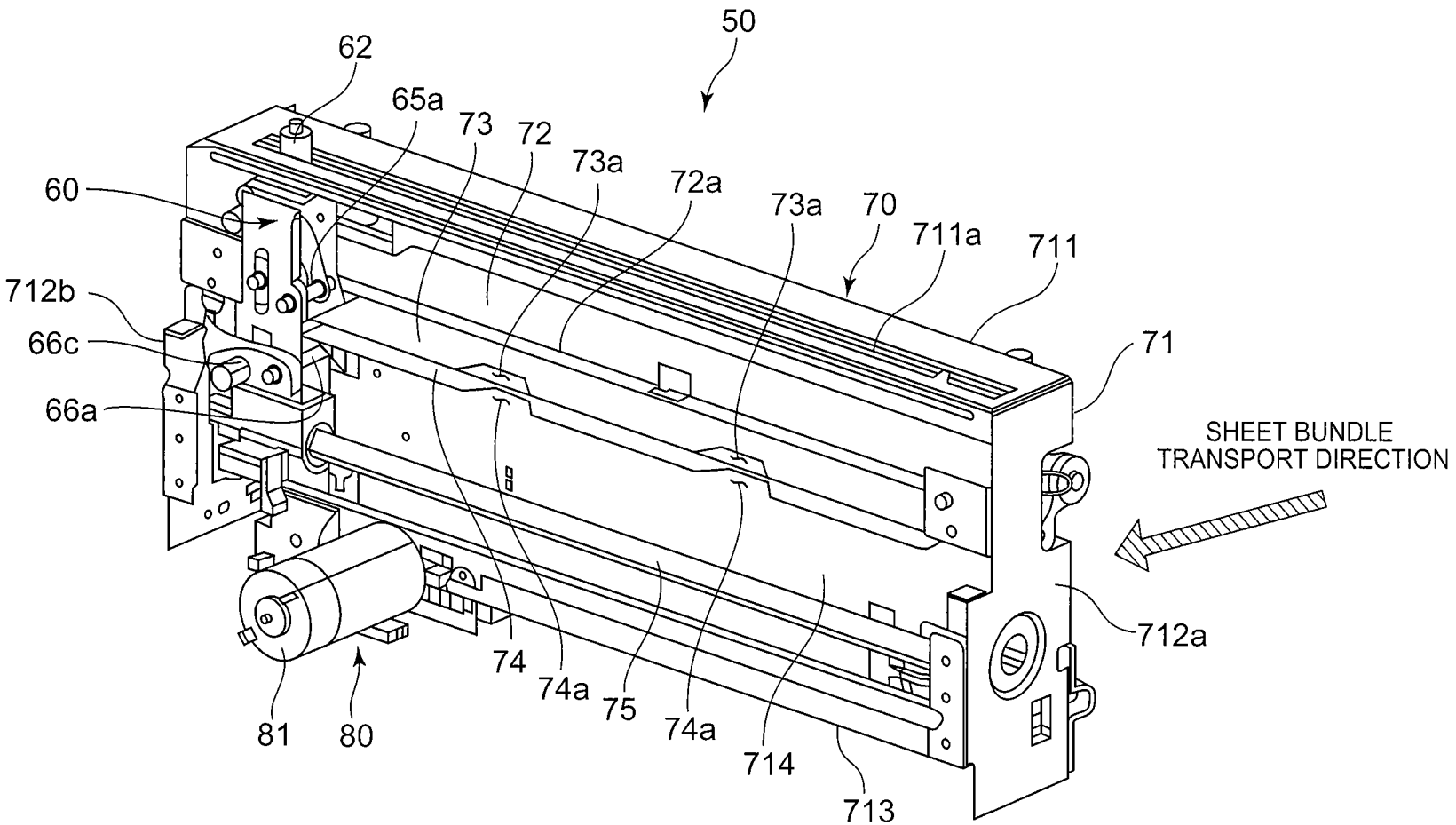
FIG. 4 is a perspective view showing an overall structure of a fold-enhancing unit.

FIG. 4 is an external perspective view showing an overall structure of the fold-enhancing unit 50. The fold-enhancing unit 50 includes a fold-enhancing roller unit 60, a support unit 70, and a drive unit 80.

The fold-enhancing roller unit 60 has the fold-enhancing roller pair 51 (see FIG. 3), and tightens the fold by moving along the fold with the fold-enhancing roller pair 51 nipping and applying pressure to the fold of the bundle of sheets pressed out of the folding roller pair 38 located upstream. Description will be given later with regard to the fold-enhancing roller unit 60, in conjunction with description of the fold-enhancing roller pair 51.

The support unit 70 supports the fold-enhancing roller unit 60 slidably in the direction along the fold, and is constructed of a nipping member for the bundle of sheets, structural members of the overall fold-enhancing unit 50, and so on.

The drive unit 80 has a drive motor 81, and the fold-enhancing roller unit 60 is driven along the fold by the drive motor 81.

Figure 5:
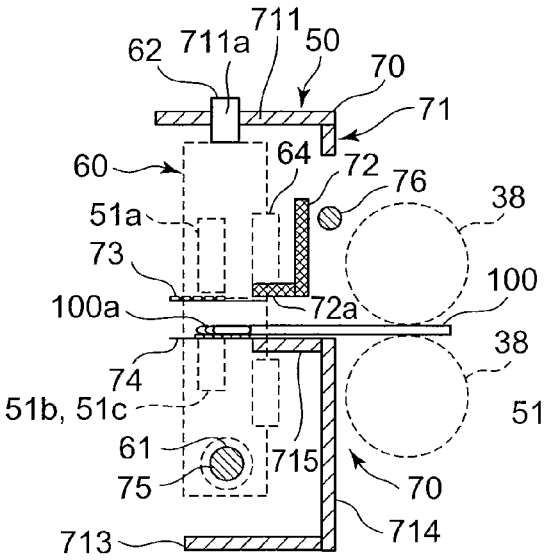
FIG. 5 is a cross-sectional view centering on a support portion of the fold-enhancing unit with fold-enhancing rollers in their standby position.
Figure 6:
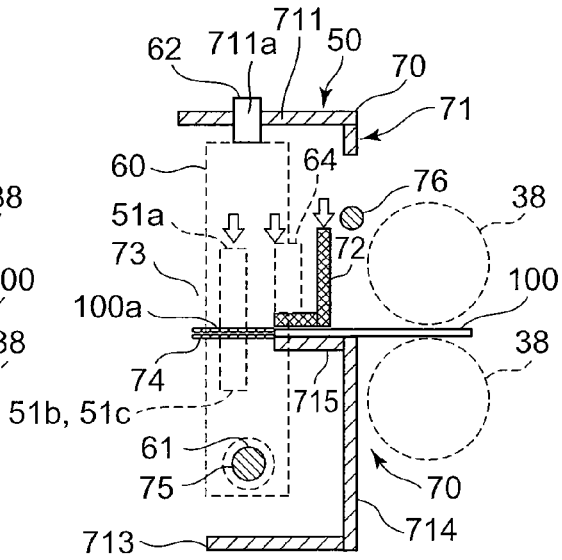
FIG. 6 is a cross-sectional view centering on the support portion of the fold-enhancing unit with the fold-enhancing rollers performing fold enhancement.

Firstly, a structure of the support unit 70 will be described by using FIG. 4 and FIGS. 5 and 6. FIGS. 5 and 6 are schematic cross-sectional views of assistance in explaining mainly the structure of the support unit 70. FIG. 5 is a cross-sectional view with the fold-enhancing roller unit 60 in its home position (i.e. its standby position, e.g., the far-left position in FIG. 4), and FIG. 6 is a cross-sectional view with the fold-enhancing roller unit 60 moving (or tightening the fold).

The support unit 70 has a frame 71, and the frame 71 is formed by a top plate 711, right and left side plates 712*a* and 712*b*, a bottom plate 713, a back plate 714, a sheet bundle loading base (or a first pinching plate) 715 (see FIGS. 5 and 6, etc.), and so on.

The top plate 711 is provided with a support hole 711*a* extending in a longitudinal direction of the top plate 711.

Also, a support shaft 75 that supports the fold-enhancing roller unit 60, a transport guide 72 having an L-shape in cross section, a drive shaft 76 for driving the transport guide 72 in an upward and downward direction, and the like are provided between the side plates 712*a* and 712*b*. Also, a transport guide roller 64 that further presses down the transport guide 72 is provided.

A flexible member (or a second flexible member) 73 in belt form made of a resin member such as polyethylene terephthalate (PET) in film form extends out from a bottom plate (or a second pinching plate) 72*a* of the transport guide 72. A similar flexible member (or a first flexible member) 74 extends out also from the sheet bundle loading base (or the first pinching plate) 715.

Incidentally, the sheet bundle loading base (or the first pinching plate) 715, the flexible member (or the first flexible member) 74, the bottom plate (or the second pinching plate) 72*a* of the transport guide 72, and the flexible member (or the second flexible member) 73 form a pinching unit.

As shown in FIGS. 5 and 6, a fold 100*a* of a bundle of sheets 100 is pinched between the flexible members 73 and 74, and the fold is tightened by being pressed by the fold-enhancing roller pair 51 (i.e. the first roller 51*a*, the second roller 51*b* and the third roller 51*c*) with the flexible members 73 and 74 in between. The flexible members 73 and 74 prevent flaws or wrinkles from appearing in the sheets.

Incidentally, edge portions of the flexible members 73 and 74 are provided with notch portions 73*a* and 74*a*, respectively. The notch portions 73*a* and 74*a* are provided at positions corresponding to the positions of staples on the fold, and prevent the flexible members 73 and 74 from being damaged by the staples.

As described later, a lower portion of the fold-enhancing roller unit 60 is provided with a through-hole 61 for the support shaft 75. Also, an upper portion of the fold-enhancing roller unit 60 is provided with a support roller 62 for holding a posture, and the support roller 62 moves along the support hole 711*a* provided in the top plate 711.

The position of the fold-enhancing roller unit 60 (except for changes in the position in a direction of movement) and the postures of three shafts are regulated by the support shaft 75 and the through-hole 61, and the support hole 711*a* and the support roller 62, and are held constant even while the fold-enhancing roller unit 60 moves.

Figure 7:
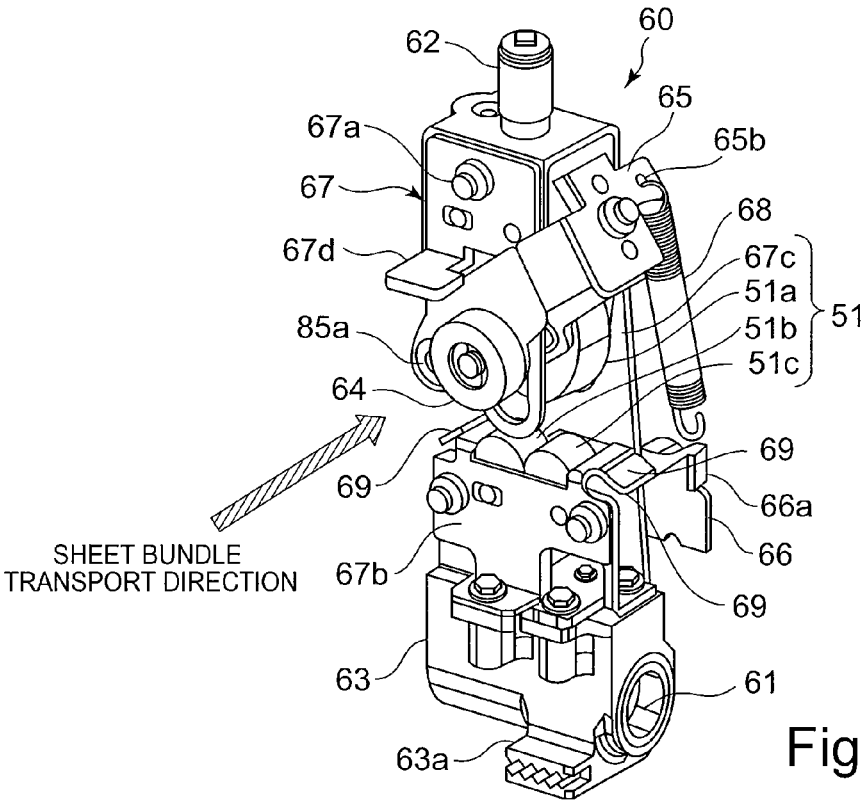
FIG. 7 is a perspective view showing a structure of a roller unit.

Next, a structure of the fold-enhancing roller unit 60 will be described. FIG. 7 is an external perspective view showing an example of the structure of the fold-enhancing roller unit 60, and is a view as seen from a direction of a source of transport of the bundle of sheets (i.e. the opposite direction to that shown in FIG. 4).

The fold-enhancing roller unit 60 is the unit having the fold-enhancing roller pair 51 built-in, and has a unit support portion 63 located in the lower portion and provided with the through-hole 61, and a roller frame 67 fixed to an upper portion of the unit support portion 63.

Figure 8:
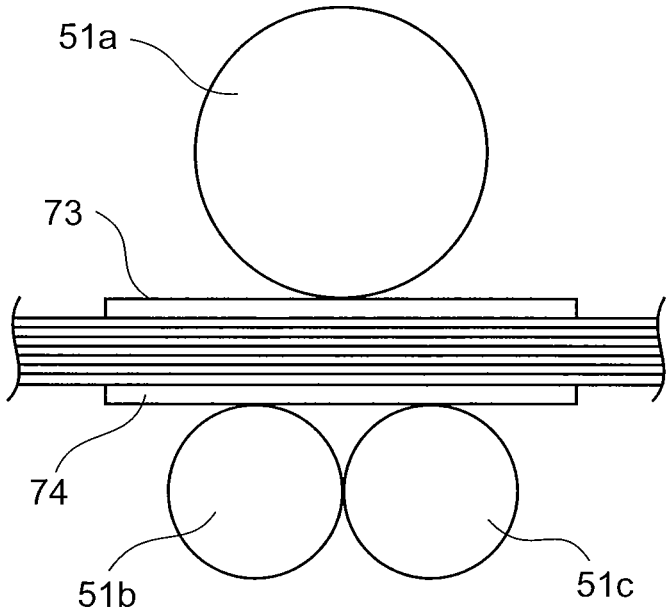
FIG. 8 is a cross-sectional view showing a fold-enhancing roller pair.

The fold-enhancing roller pair 51 in the embodiment will be described by using FIG. 8. FIG. 8 is a cross-sectional view showing the fold-enhancing roller pair 51 as viewed from a sheet transport direction. As shown in FIG. 8, the fold-enhancing roller pair 51 of the embodiment is formed of the first roller 51*a* facing a top surface (or a first surface) of the bundle of sheets, and the second roller 51*b* and the third roller 51*c* facing a bottom surface (or a second surface) of the bundle of sheets. A nip is formed by the first roller 51*a* and the second roller 51*b*, and a nip is formed by the first roller 51*a* and the third roller 51*c*. The bundle of sheets is nipped in the nips at two points to undergo fold enhancement. In other words, fold-enhancing forces are exerted on the two points, and thus, the bundle of sheets can be subjected to tight fold enhancement, as compared to an instance where a nip is present at a single point.

Also, a roller having a larger diameter than those of the second roller 51*b* and the third roller 51*c* is used as the first roller 51*a*. When the roller having the larger diameter than those of the second roller 51*b* and the third roller 51*c* is used as the first roller 51*a*, a distance between the nip between the first roller 51*a* and the second roller 51*b* and the nip between the first roller 51*a* and the third roller 51*c* is increased, and thus, fold enhancement of the bundle of sheets can take place with stability, as compared to an instance where all three rollers have the same diameter.

The roller frame 67 shown in FIG. 7 includes an upper frame 67*a* having a hollow portion, a lower frame 67*b* likewise having a hollow portion, and a frame plate 67*c* by which the upper frame 67*a* and the lower frame 67*b* are fixedly joined together.

Also, the fold-enhancing roller unit 60 has an upper link member 65 and a lower link member 66, which are spring-joined together by a spring 68. One end of the spring 68 is engaged in a hook hole 65*b* of the upper link member 65, and the other end of the spring 68 is engaged in a notch portion 66*b* of the lower link member 66. In FIG. 7, the spring 68 is shown as being in a free state in which the other end of the spring 68 is disengaged from the notch portion 66*b*; however, actually, with the other end of the spring 68 engaged in the notch portion 66*b*, a tensile force of the spring 68 is applied between the upper link member 65 and the lower link member 66.

The second roller 51*b* and the third roller 51*c* of the fold-enhancing roller pair 51 are accommodated in the hollow portion of the lower frame 67*b*. The second roller 51*b* and the third roller 51*c* are supported individually rotatably around a lower roller shaft (not shown) fixed to the lower frame 67*b*.

Also, the lower link member 66 is rotatably joined to a side surface of the lower frame 67*b* by a lower link shaft 66*a* (see FIG. 4) fixed to the lower frame 67*b*.

The first roller 51*a* as one of the fold-enhancing roller pair 51 is accommodated in the hollow portion of the upper frame 67*a*. The first roller 51*a* is supported rotatably around an upper roller shaft (not shown) fixed to the upper link member 65.

Rotating shafts of the second roller 51*b* and the third roller 51*c* are each fixed to the lower frame 67*b*, and the positions of the second roller 51*b* and the third roller 51*c* do not change in the upward and downward direction even when the fold-enhancing roller unit 60 moves. The positions of upper ends of the second roller 51*b* and the third roller 51*c* are adjusted so as to coincide with the position of the flexible member 74, and, when the fold-enhancing roller unit 60 moves, the second roller 51*b* and the third roller 51*c* rotate in contact with the underside of the flexible member 74.

Meanwhile, the upper roller shaft of the first roller 51*a* is fixed to the upper link member 65. When the fold-enhancing roller unit 60 moves away from its home position and starts moving, the upper link member 65 is pulled by the spring 68 and starts rotating downward around an upper link shaft 65*a*. By this rotation, the first roller 51*a* rotatably mounted to the upper link member 65 starts moving downward and moves to a position where the first roller 51*a* comes in contact with the second roller 51*b* and the third roller 51*c*. Urging forces caused by the tensile force of the spring 68 interact between the first roller 51*a* and the second and third rollers 51*b* and 51*c*. Actually, the bundle of sheets is pinched between the first roller 51*a* and the second and third rollers 51*b* and 51*c* with the flexible members 73 and 74 in between, and thus, the fold of the bundle of sheets is tightened by the urging forces between the first roller 51*a* and the second and third rollers 51*b* and 51*c*.

With the above-described structure, in the fold-enhancing roller pair 51, the first roller 51*a* is movable in a direction of a thickness of the bundle of sheets, and the second roller 51*b* and the third roller 51*c* are fixed so as not to move in the direction of the thickness of the bundle of sheets. The first roller 51*a* is movable in a vertical direction, and thereby, the bundle of sheets can be nipped in the nips of the fold-enhancing roller pair 51.

Figure 9:
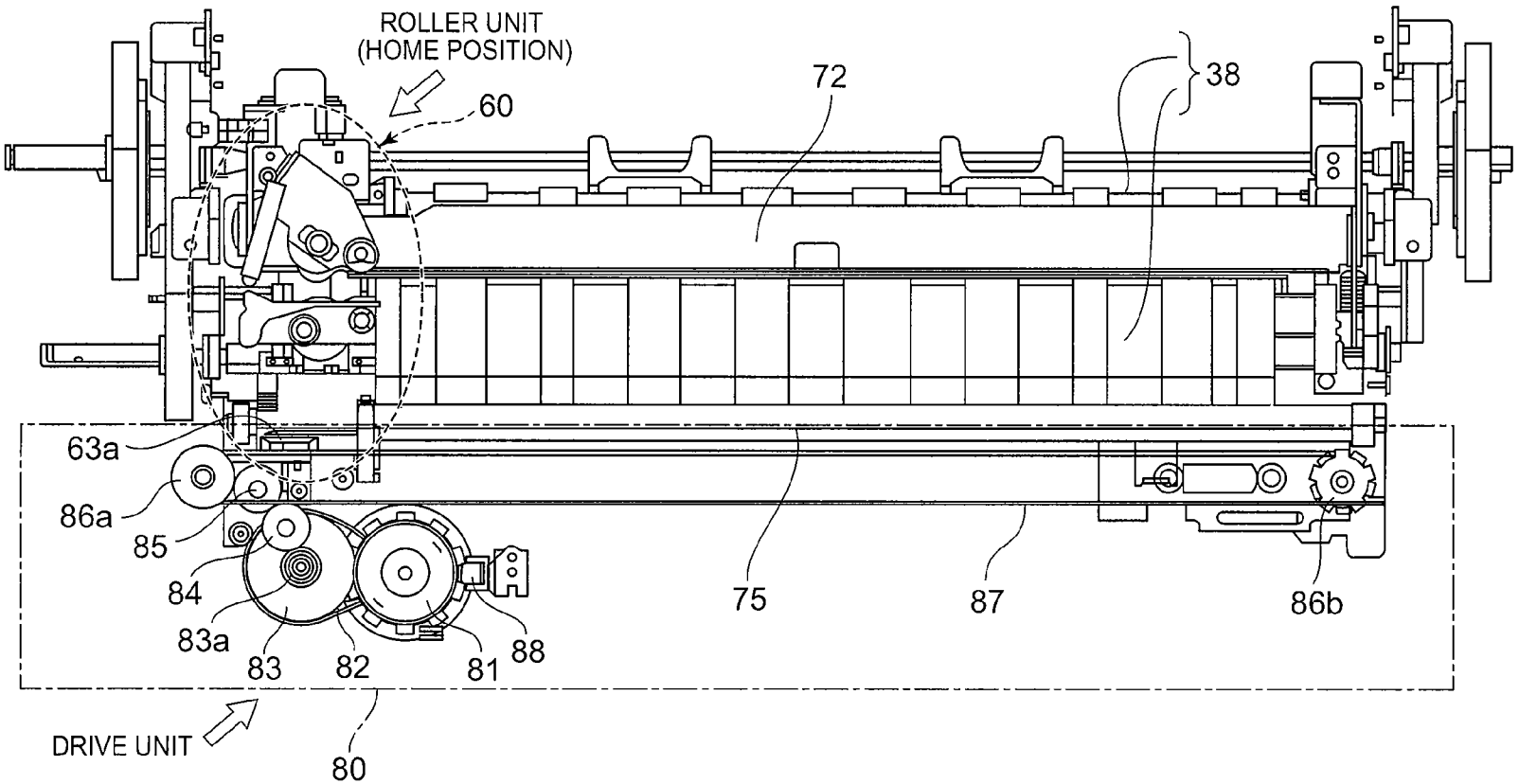
FIG. 9 is a view showing the fold-enhancing unit as viewed from a destination of transport of a bundle of sheets.

Next, a structure of the drive unit 80 will be described. FIG. 9 is a view showing a configuration of the drive unit 80 and an example of the structure thereof. FIG. 9 is a view as seen in a direction from a destination of transport of the bundle of sheets to the source of transport thereof, and also showing, in conjunction, the fold-enhancing roller unit 60 in its home position, and the folding roller pair 38 and a driving mechanism for the folding roller pair 38.

The drive unit 80 has the drive motor 81 as the sole driving source of the fold-enhancing unit 50. The drive motor 81 is a DC motor, and its rotation direction or rotation speed can be externally controlled.

A driving force from the drive motor 81 is transmitted through a motor belt 82 to a pulley 83, and is further transmitted from a gear 83*a* of the pulley 83 through a gear 84 and a gear 85 to a driving side pulley 86*a*. Meanwhile, a unit driving belt 87 extends between the driving side pulley 86*a* and a follower side pulley 86*b*. The unit driving belt 87 moves from one to another of the driving side pulley 86*a* and the follower side pulley 86*b* by the driving force from the drive motor 81.

A rack is formed on the surface of the unit driving belt 87, and the rack mates with teeth of a mating portion 63*a* provided in the lower portion of the fold-enhancing roller unit 60, thereby ensuring that the fold-enhancing roller unit 60 can be moved in the direction along the fold without slipping. A direction of movement of the unit driving belt 87 can be changed by reversing the direction of rotation of the drive motor 81, and the fold-enhancing roller unit 60 can travel back and forth.

When performing fold enhancement, the fold-enhancing roller unit 60 starts moving at its home position, moves along the fold of the bundle of sheets while tightening the fold, and temporarily stops at an end portion of the bundle of sheets opposite to the home position. After that, the fold-enhancing roller unit 60 moves back to the home position, while subsequently tightening the fold.

Positions where the fold-enhancing roller unit 60 temporarily stops at the end portion of the bundle of sheets opposite to the home position vary according to paper size, and the position of temporary stop is determined based on paper size information.

Also, in the home position, the first roller 51*a* and the second and third rollers 51*b* and 51*c* are separated from each other. Description will be given with regard to a separation mechanism of the fold-enhancing roller pair 51 in the home position.

Figure 10:
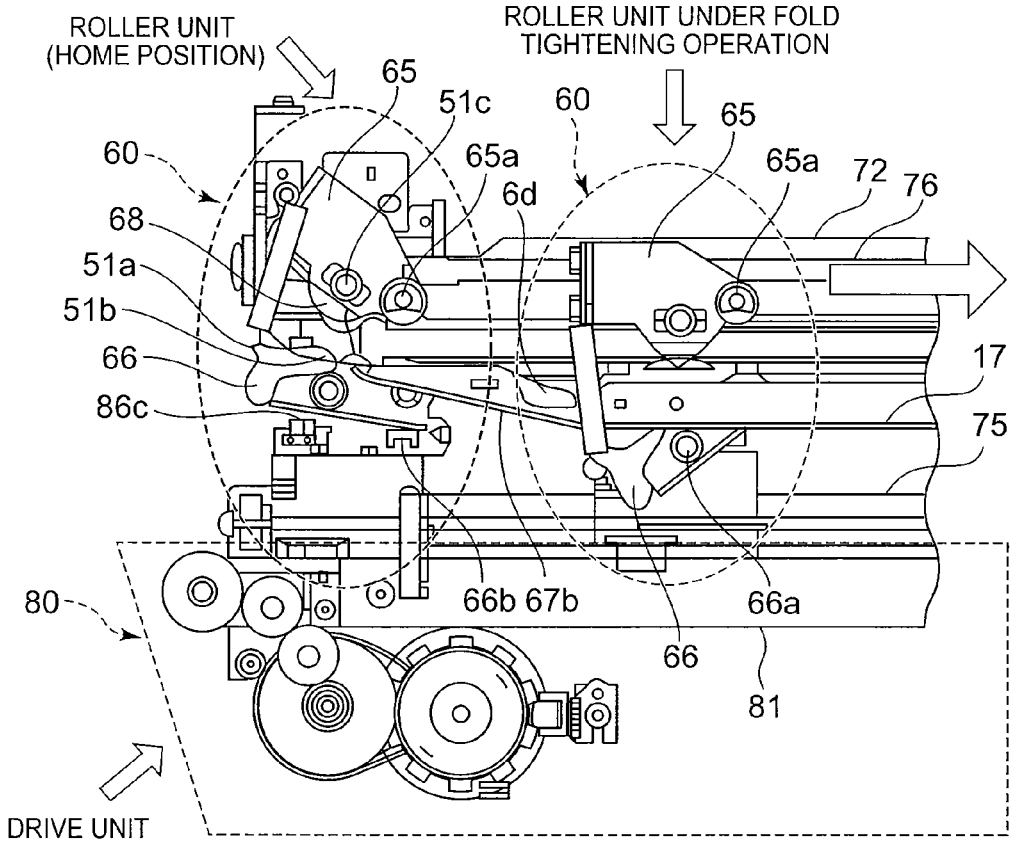
FIG. 10 is a view of assistance in explaining a mechanism of a separation mechanism of the fold-enhancing roller pair.

FIG. 10 is a view of assistance in explaining a mechanism of the separation mechanism of the fold-enhancing roller pair 51. As mentioned above, the upper link member 65 and the lower link member 66 of the fold-enhancing roller unit 60 are spring-joined by the spring 68 at the position farthest away from their respective rotating shafts (65*a* and 66*a*). Also, the lower link member 66 is provided with a guide roller 66*c* that freely rotates.

Meanwhile, the support unit 70 has a guide rail 77 having an L-shape in cross section, as shown in FIG. 10. The guide rail 77 has an inclined slope portion 77*a*, and is parallel to the direction of the fold of the bundle of sheets, except for the slope portion 77*a*.

When the fold-enhancing roller unit 60 moves away from its home position, the guide roller 66*c* moves downward along a bottom surface of the slope portion 77*a* of the guide rail 77. As the guide roller 66*c* moves downward, the lower link member 66 rotates about the lower link shaft 66*a* in a counterclockwise direction. Also, the upper link member 65 is pulled by the spring 68 and rotates about the upper link shaft 65*a* in the counterclockwise direction. Consequently, while the fold-enhancing roller unit 60 moves along the slope portion 77*a*, the first roller 51*a* located between the upper link shaft 65*a* and the hook hole 65*b* of the spring 68 gradually moves downward, and a distance between the first roller 51*a* and the second and third rollers 51*b* and 51*c* becomes progressively shorter. Then, when the slope portion 77*a* ends, the first roller 51*a* comes in contact with the second roller 51*b* and the third roller 51*c*. Incidentally, before the slope portion 77*a* ends, the first roller 51*a* may come in contact with the second roller 51*b* and the third roller 51*c*. At this time, pressures which the first roller 51*a* and the second and third rollers 51*b* and 51*c* apply to each other (that is, pressing) act between the first roller 51*a* and the second and third rollers 51*b* and 51*c*. This pressing is based on the tensile force of the spring 68.

In a horizontal region of the guide rail 77, the first roller 51*a* and the second and third rollers 51*b* and 51*c* apply pressure to the fold of the bundle of sheets while maintaining the above-described pressing, thereby tightening the fold.

Thus, in the home position where fold enhancement is not performed, the first roller 51*a* and the second and third rollers 51*b* and 51*c* are separated from each other, which in turn enables preventing the rollers from being always in contact with each other, thus applying pressure to each other, and hence deteriorating.

Next, a series of operations of the sheet post-processing device 20 having the above-described configuration will be described in outline. In FIG. 2, a sheet S having an original document image printed by the image forming unit 12 is ejected from the image forming apparatus 10 to the sheet post-processing device 20 through the fixing unit 8. The ejected sheet S enters the saddle stitch processor 30.

In the saddle stitch processor 30 shown in FIG. 3, the sheet S is loaded on the stacker 35 along the standing tray 34. With a predetermined number of sheets S loaded, the stacker 35 moves downward until the position of the bundle of sheets to be folded (e.g. the stapled position, which is the center of the bundle of sheets in the direction from top to bottom thereof) comes to the front of the middle folding blade 37.

Then, the middle folding blade 37 operates to feed the bundle of sheets into the nip portion of the folding roller pair 38. The bundle of sheets is fed by rotation of the roller pair 38, and, in a folded state, is transported to a position between the flexible members 73 and 74, as shown in FIG. 5. The folding roller pair 38 that has transported the bundle of sheets 100 to this position stops temporarily. Thereby, the fold 100*a* of the bundle of sheets 100 is located between the flexible members 73 and 74.

Then, as mentioned above, the fold-enhancing roller unit 60 located in its home position starts moving along the guide rail 77. The fold-enhancing roller unit 60 moves downward along the slope portion of the guide rail 77, and, in the process of this movement, the bundle of sheets 100 located between the flexible members 73 and 74 is pinched between the first roller 51*a* and the second and third rollers 51*b* and 51*c* that form the fold-enhancing roller unit 60. This state is shown in FIG. 6.

Further, in a state shown in FIG. 8 in which the bundle of sheets 100 is pinched between the first roller 51*a* and the second and third rollers 51*b* and 51*c*, the fold-enhancing roller unit 60 moves along the guide rail 77, for example, in a rightward direction in FIG. 9 (i.e. the direction along the fold). In the process of this movement, the fold portion 100*a* of the bundle of sheets 100 pinched between the first roller 51*a* and the second and third rollers 51*b* and 51*c* is subjected to fold-enhancing by the nip portions between the rollers.

For example at the time when the fold-enhancing roller unit 60 deviates from the bundle of sheets, the fold-enhancing roller unit 60 moving in the direction along the fold of the bundle of sheets stops temporarily, and then, by reversing the direction of rotation of the drive motor 81, the fold-enhancing roller unit 60 moves along the guide rail 77 in the opposite direction (i.e. toward the home position) and tightens the fold of the bundle of sheets in the same manner.

When the fold-enhancing roller unit 60 returns to the home position, the folding roller pair 38 stopping temporarily is driven again, and the bundle of sheets having the tightened fold portion is ejected to the sheet bundle loading unit 40 shown in FIG. 2. Incidentally, the first roller 51*a* and the second and third rollers 51*b* and 51*c* of the fold-enhancing roller unit 60 that has returned to the home position return to an initial position where the rollers are separated from each other.

By the above-described mechanism and operations, fold-enhancing using the fold-enhancing roller pair 51 is performed. One roller is located on one side and two rollers forming the nips with the one roller are located on the other side with the bundle of sheets in between thereby to form the fold-enhancing roller pair, and thus, the nips that nip the bundle of sheets are formed at two points, so that the bundle of sheets have two points to which the fold-enhancing roller pair applies pressure. In other words, the bundle of sheets can be subjected to tight fold enhancement, as compared to an instance where a nip is formed at a single point.

Incidentally, in the fold-enhancing roller pair 51 of the above-described embodiment, one roller is provided facing the top surface of the bundle of sheets, and two rollers are provided facing the bottom surface of the bundle of sheets; however, the embodiment is not so limited, and two rollers may be provided facing the top surface of the bundle of sheets, and one roller may be provided facing the bottom surface of the bundle of sheets. Also, the first roller 51*a* is movable in the direction of the thickness of the bundle of sheets, and the second roller 51*b* and the third roller 51*c* are fixed in the direction of the thickness of the bundle of sheets; however, the embodiment is not so limited. The bundle of sheets can be nipped, provided that, in the fold-enhancing roller pair 51 that nips the bundle of sheets, any one of the roller facing the top surface of the bundle of sheets and the roller facing the bottom surface thereof is movable in the vertical direction.

Figure 11:
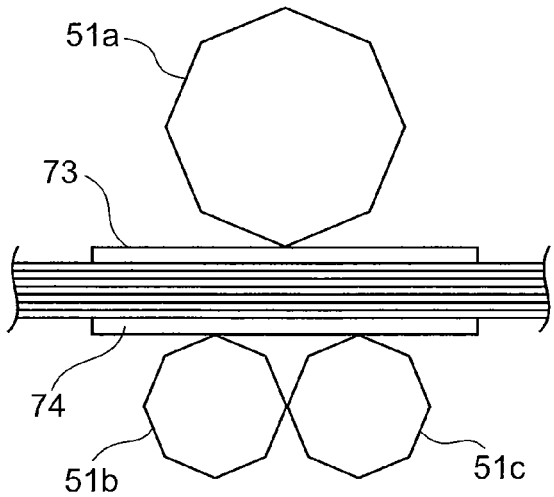
FIG. 11 is a cross-sectional view showing a modification of the fold-enhancing roller pair.

Also, in the above-described embodiment, the first roller 51*a*, the second roller 51*b* and the third roller 51*c* are circular in cross section in the sheet transport direction; however, as shown in FIG. 11, the rollers may be polygonal in cross section in the sheet transport direction. By using the polygonal rollers, the nips between the rollers are definitely formed, and thus, tight fold enhancement can also be performed.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form the methods and systems described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a folding roller unit configured to form a fold in a sheet while the sheet passes through a nip of paired rollers;

a fold-enhancing roller unit having a first roller, a second roller, and a third roller, the first roller being provided facing a first surface of the sheet folded by the folding roller unit, orthogonal to a direction of transport of the sheet, the second roller and the third roller which are provided facing a second surface of the sheet orthogonal to the direction of transport of the sheet and different from the first surface, the second roller and the third roller forming nips with the first roller; and a drive unit configured to move the fold-enhancing roller unit along the fold with the sheet nipped in the nip between the first roller and the second roller and in the nip between the first roller and the third roller.

2. The sheet processing apparatus according to claim 1, wherein the second roller and the third roller are fixed in a direction of a thickness of the sheet, and the first roller is movable in the direction of the thickness of the sheet.

3. The sheet processing apparatus according to claim 1, wherein the first roller is fixed in a direction of a thickness of the bundle of sheets, and the second roller and the third roller are movable in the direction of the thickness of the bundle of sheets.

4. The sheet processing apparatus according to claim 1, wherein a diameter of the first roller is larger than a diameter of the second roller and a diameter of the third roller.

5. The sheet processing apparatus according to claim 1, wherein the first roller and the second and third rollers are separate, when fold enhancement of the sheet is not performed.

6. The sheet processing apparatus according to claim 1, wherein the first roller, the second roller and the third roller are approximately circular in cross section in the direction of transport of the sheet.

7. The sheet processing apparatus according to claim 1, wherein the first roller, the second roller and the third roller are approximately polygonal in cross section in the direction of transport of the sheet.

8. An image forming apparatus comprising:

a reading unit configured to read an original document and generates image data;

an image forming unit configured to print the image data generated by the reading unit on a sheet; and a sheet processing apparatus including a folding roller unit configured to form a fold in the sheet while the sheet passes through a nip of paired rollers; a fold-enhancing roller unit having a first roller, a second roller, and a third roller, the first roller being provided facing a first surface of the sheet folded by the folding roller unit, orthogonal to a direction of transport of the sheet, the second roller and the third roller are provided facing a second surface of the sheet orthogonal to the direction of transport of the sheet and different from the first surface, the second roller and the third roller forming nips with the first roller; and a drive unit configured to move the fold-enhancing roller unit along the fold with the sheet nipped in the nip between the first roller and the second roller and in the nip between the first roller and the third roller, wherein the sheet processing apparatus forms the fold in the sheet printed by the image forming unit.

9. The image forming apparatus according to claim 8, wherein the second roller and the third roller are fixed in a direction of a thickness of the sheet, and the first roller is movable in the direction of the thickness of the sheet.

10. The image forming apparatus according to claim 8, wherein the first roller is fixed in a direction of a thickness of the bundle of sheets, and the second roller and the third roller are movable in the direction of the thickness of the bundle of sheets.

11. The image forming apparatus according to claim 8, wherein a diameter of the first roller is larger than a diameter of the second roller and a diameter of the third roller.

12. The image forming apparatus according to claim 8, wherein the first roller and the second and third rollers are separated, when fold enhancement of the sheet is not performed.

13. The image forming apparatus according to claim 8, wherein the first roller, the second roller and the third roller are approximately circular in cross section in the direction of transport of the sheet.

14. The image forming apparatus according to claim 8, wherein the first roller, the second roller and the third roller are approximately polygonal in cross section in the direction of transport of the sheet.

15. A sheet processing method in which a sheet folded by a folding roller unit is subjected to fold enhancement by a fold-enhancing roller unit having a first roller, a second roller, and a third roller, the first roller being provided facing a first surface of the bundle of sheets orthogonal to a direction of transport of the sheet, the second roller and the third roller are provided facing a second surface of the sheet orthogonal to the direction of transport of the sheet and different from the first surface, the second roller and the third roller forming nips with the first roller, comprising:

stitching a bundle of sheets on its approximate center portion;

forming a fold by folding the bundle of sheets on the approximate center portion;

nipping the bundle of sheets in the nip between the first roller and the second roller and in the nip between the first roller and the third roller; and moving the fold-enhancing roller unit along the fold with the bundle of sheets nipped by the first roller and the second roller and the third roller.

16. The sheet processing method according to claim 15, wherein the second roller and the third roller are fixed in a direction of a thickness of the bundle of sheets, and the first roller moves in the direction of the thickness of the bundle of sheets.

17. The sheet processing method according to claim 15, wherein the first roller is fixed in a direction of a thickness of the bundle of sheets, and the second roller and the third roller move in the direction of the thickness of the bundle of sheets.

18. The sheet processing method according to claim 15, wherein the first roller and the second roller and the third roller are separated, when the fold enhancement of the bundle of sheets is not performed.

* * * * *